United States Patent [19]

Bellsmith

[11] 3,971,162

[45] July 27, 1976

[54] PORTABLE SPARK PLUG CLEANER

[76] Inventor: Joseph L. Bellsmith, 12612 Sungrove Circle, Garden Grove, Calif. 92640

[22] Filed: June 5, 1975

[21] Appl. No.: 584,207

[52] U.S. Cl. ..... 51/8 SP

[51] Int. Cl.[2] ..... B24C 3/34

[58] Field of Search ..... 51/8 R, 8 SP, 11, 12

[56] References Cited

UNITED STATES PATENTS

| | | | |
|---|---|---|---|
| 2,505,422 | 4/1950 | Michaels | 51/8 SP |
| 2,515,336 | 7/1950 | Christie | 51/8 SP X |
| 3,385,005 | 5/1968 | Nielsen | 51/8 SP |

OTHER PUBLICATIONS

Trial Voluntary Protest Program Published Application B353,546 to Romanowicz.

*Primary Examiner*—Al Lawrence Smith
*Assistant Examiner*—Nicholas P. Godici

[57] ABSTRACT

A portable spark plug cleaning device which utilizes pressure from a gas pressurized container to impel abrasive particles against a spark plug which is held in an adapter.

2 Claims, 2 Drawing Figures

PORTABLE SPARK PLUG CLEANER

BACKGROUND OF THE INVENTION

Spark plugs are an important part of all internal combustion engines when such engines are operated continuously for long periods of time unburned carbon deposits build up on the electrode sections of the ignition plugs. The elements of the electrodes also tend to oxidize after long exposure to a high temperature environment increasing the resistance of the electrode efficiency. Various impurities and complex hydrocarbons are components of the ignition stage of an engine operation and these also tend to accumulate and coat the electrodes with a further drop in efficiency and increase in resistance.

Numerous devices have been invented to clean the electrodes in order to lengthen the service life of the spark plugs.

U.S. Pat. Nos. 2,257,144 and 2,314,556 describe such devices which are designed to accomplish the cleaning process. Both patents describe machines which are heavy, and relatively expensive and stationary.

Devices have been created which are intended to be lower cost and portable.

U.S. Pat. Nos. 2,376,497; 3,538,644 and 3,435,561 describe these devices. All of them rely upon an external source of high pressure air for their operation.

U.S. Pat. No. 3,538,644 describes the use of a slatted venturi to increase air velocity and contemplates using low air pressure from vacuum cleaner exhausts or other low pressure sources.

None of the prior patents disclose a truly portable spark plug cleaner that can be easily used by the average auto owner.

SUMMARY OF THE INVENTION

It is an object of the present invention to provide a portable spark plug cleaner that does not require a vacuum cleaner air source or a venturi to use low pressure air sources.

It is a further object of this invention to provide a gas pressurized container which contains fine grit that is used with the portable device of this invention to clean spark plugs.

These together with other objects and advantages which will become apparent are illustrated in the accompanying drawings, forming a part thereof.

Figure 1:
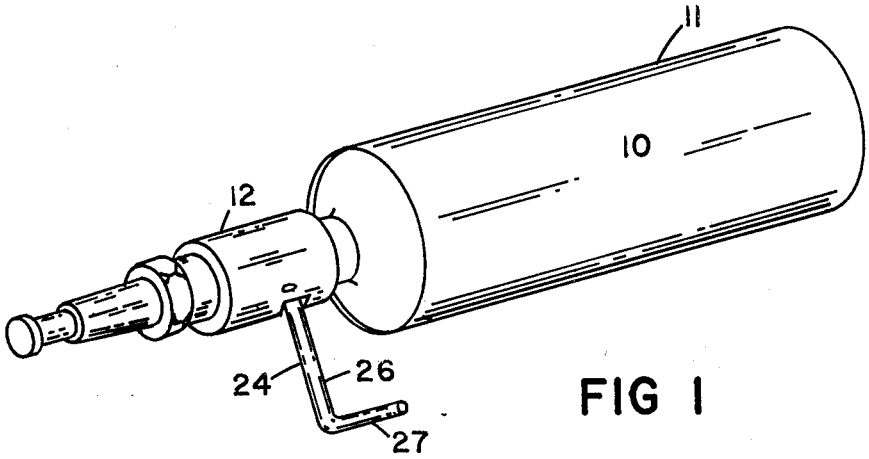
FIG. 1 is an elevational side view of the device.
Figure 2:
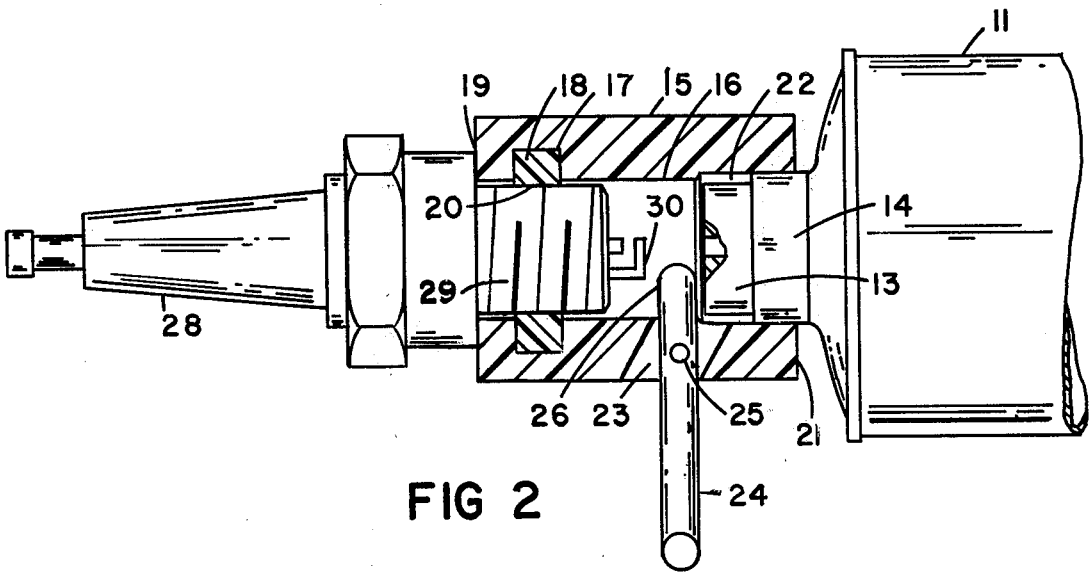
FIG. 2 is a cross sectional view of the adapter engaged on a gas pressurized container.

As shown in FIG. 1 and 2 a portable spark plug cleaning device 10 comprises a gas pressurized, grit dispensing container 11 having a spark plug adaptor assembly 12 engaged thereon.

The container 11 has a normally closed, top discharging, reciprocating nozzle valve 13 extending from a forward boss 14.

The spark plug adaptor assembly 12 comprises a rod 15 having an axial bore 16 therethrough. A radial recess 17 containing a resilient ring seal 18 is located in the forward end 19 of the bore 16. The seal 18 has an inside diameter 20 less than the basic major diameter of a spark plug thread whereby a gas tight seal may be formed on a spark plug thread. The seal 18 is removable so that seals for different diameter spark plug threads may be inserted. The aft end 21 of the bore 16 has a controlled inside diameter 22 whereby the adaptor 12 may be engaged over the forward boss 14 of the container 11. A radial vent port 23 extends angularly aft into the bore 16 and a substantially "L" shaped valve actuator rod 24 extends into the vent port 23 and is pivotally attached to the adaptor 12 by a pin 25.

The first end 26 of the valve actuator rod 24 extends into the bore 16 thru the vent port 23 and abuts the nozzle valve 13 and the second end 27 of the valve actuator rod 24 depends below the adaptor 12, substantially perpendicular to the first end 26 and provides a member to be gripped.

In operation a spark plug 28 is engaged by its threads 29 in the resilient ring seal 18 with its electrodes 30 facing the top discharging reciprocating nozzle valve 13; the second end 26 of the valve actuator rod 23 is pushed forward which pivots the first end 25 to the rear opening the nozzle valve 13 allowing the pressurized gas and grit to escape thru the top discharging nozzle valve 13 and impinge on the electrodes 30 to remove the carbon deposits and other fouling therefrom. The pressurized gas and grit exhaust to embient atmosphere thru the vent port 23.

The angled attitude of the vent port 23 exhausts the gas and grit away from the user and also precludes the first end 25 of the valve actuator rod 24 from being moved forward which could result in damage to the spark plug electrode 30.

The spark plug 28 may be rotated in the ring seal 18 to present all the electrode 30 areas to the gas and grit.

The "L" shape of the valve actuator rod 24 prevents the hand and fingers of the user from being in the gas and grit exhaust from the vent port 23.

The adaptor rod 15 is shown as being made of plastic but any suitable material such as metal may be used.

The valve adaptor rod 24 is shown as metal but any suitable material such as plastic may be used.

The gas for pressurizing the container 11 may be any suitable gas such as aerosol, CO2 or air and the container 11 may be either disposable or rechargeable.

I claim:

1. A portable spark plug cleaning device comprising:

a. a gas pressurized, grit dispensing container having a normally closed, top discharging, reciprocating nozzle valve extending from a forward boss; and b. a spark plug adaptor assembly engaged on said forward boss;

wherein the spark plug adaptor assembly comprises:

a. a rod having an axial bore therethrough;

b. a radial annular recess in the forward end of said axial bore;

c. a resilient ring seal located in said radial annular recess;

d. a controlled inside diameter in the aft end of said axial bore whereby said inside diameter may be engaged on said forward boss;

e. a substantially "L" shaped valve actuator rod pivotally mounted to said spark plug adaptor.

2. The device as described in claim 1 wherein said pivotally mounted valve actuator rod comprises:

a. a first end extending into said vent port to abut said normally closed, top discharging, reciprocating nozzle valve; and b. a second end substantially perpendicular to said first end and depending below said spark plug adaptor whereby with a spark plug engaged in said resilient ring seal with said electrodes facing said top discharging nozzle valve, said second end may be pushed forward pivoting said first end to the rear, opening said normally closed top discharging, reciprocating nozzle valve to allow said pressurized gas and said grit to escape and impinge on said spark plug electrodes to remove the carbon deposits and other fouling therefrom.

* * * * *